United States Patent [19]

Abura et al.

[11] 4,203,431

[45] May 20, 1980

[54] FACIAL TREATMENT DEVICE

[75] Inventors: Yoshinori Abura; Yuritugu Toyomi; Motohisa Nishino, all of Hikone, Japan

[73] Assignee: Matsushita Electric Works, Ltd., Osaka, Japan

[21] Appl. No.: 900,797

[22] Filed: Apr. 27, 1978

[30] Foreign Application Priority Data

May 6, 1977 [JP] Japan ..... 52-52396

[51] Int. Cl.[2] ..... A61H 1/00

[52] U.S. Cl. ..... 128/39; 128/56

[58] Field of Search ..... 128/38–40, 128/56, 299–302

[56] References Cited

U.S. PATENT DOCUMENTS

| | | | |
|---|---|---|---|
| 861,610 | 7/1907 | Sarver | 128/56 |
| 1,686,598 | 10/1928 | Broadbent | 128/56 |
| 1,919,571 | 7/1933 | Pinkston | 128/56 |
| 2,218,443 | 10/1940 | Tweddle | 128/297 |
| 2,519,790 | 8/1950 | Quinn | 128/38 |
| 3,272,200 | 9/1966 | Friedmann | 128/56 |
| 3,906,940 | 9/1975 | Kawada | 128/40 |

*Primary Examiner*—Lawrence W. Trapp

*Attorney, Agent, or Firm*—Burns, Doane, Swecker & Mathis

[57] ABSTRACT

A facial treatment device wherein an air pumping means and a rotary member are driven by a rotary power source so as to perform skin cleaning and massaging actions with sucking and rotary functions through a sucking or rotary attachment. A stationary shaft having an axial hole is provided in the device to have an end of the hole communicated with air-intake side of the pumping means and the other end exposed to the exterior, and the rotary member is rotatably supported coaxially with the stationary shaft. The sucking attachment is mounted to the stationary shaft at said the other end of its axial hole, whereas the rotary attachment is mounted, in place of the sucking attachment, to the rotary member made accessible thereto on the same side with said end of the stationary shaft to which the sucking attachment is mounted. Preferably, the common axis of the stationary shaft and rotary member is disposed to intersect at right angles the axis of rotary output shaft of the power source.

12 Claims, 22 Drawing Figures

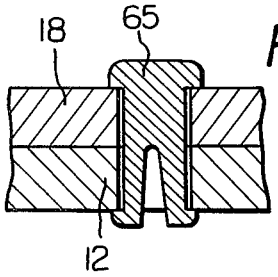
Fig. 15
Fig. 16
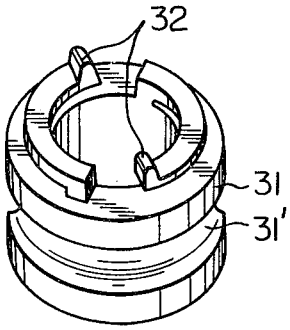
Fig. 17
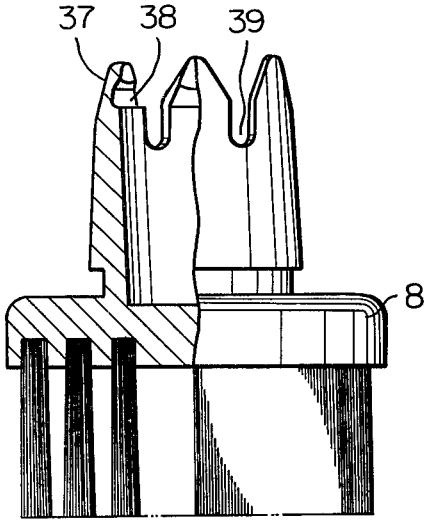

FACIAL TREATMENT DEVICE

This invention relates generally to facial treatment devices and, more particularly, to improvements in the facial treatment device of a type which performs both skin cleaning and massaging actions by means of sucking and rotary functions.

In the device of the kind referred to, either a vibratory power source or rotary power source has been used as a common driving source for respective mechanisms performing the cleaning and massaging actions. The vibratory power source is convenient in achieving the sucking function for performing the skin cleaning action but, as its motion is limited to reciprocal movements, the massaging action achievable by the vibratory power source is restricted to be of pushing type. While the rotary power source requires, on the other hand, means for converting the rotary motion into the vibratory motion for achieving the sucking function, the rotary motion can be directly utilized for another type skin cleaning such as brushing and also for another type massaging such as rubbing, in addition to the sucking type cleaning and pushing type massaging actions, the latter of which is achievable by employing any proper means. Accordingly, the rotary power source has been widely used recently in various type facial treatment devices, but there have been still involved certain problems in these conventional devices such that a rotary shaft driven by a motor and mounting thereto a rotary brushing or massaging attachment and a stationary tubular member communicating a sucking attachment mounted thereto with an air pumping means driven by the motor are separately disposed in the device so as to project out of its body generally in opposite directions, whereby the device body is caused to become bulky and the use of the device is made inconvenient.

The present invention has been suggested in view of the foregoing problems and has successfully solved then by providing a rotary member driven by a motor coaxially with a stationary shaft having an axial hole communicated at an end with a pump chamber and at the other and with the exterior so that the rotary member and stationary shaft will be accessible on one side of the device body for selectively mounting a rotary attachment to the rotary shaft and a sucking attachment to the stationary shaft.

A primary object of the present invention is, therefore, to provide a facial treatment device which is compact in size and easy to use.

Another object of the present invention is to provide a facial treatment device which allows to mount and dismount selective one of the rotary and sucking attachments to the device only on one side thereof.

A related object of the present invention is to provide a facial treatment device of which the inner space is utilized at a high efficiency.

Other objects and advantages of the present invention shall be made clear upon reading the following descriptions thereof detailed with reference to a most preferable embodiment of the invention shown in accompanying drawings, in which.

Figure 1:
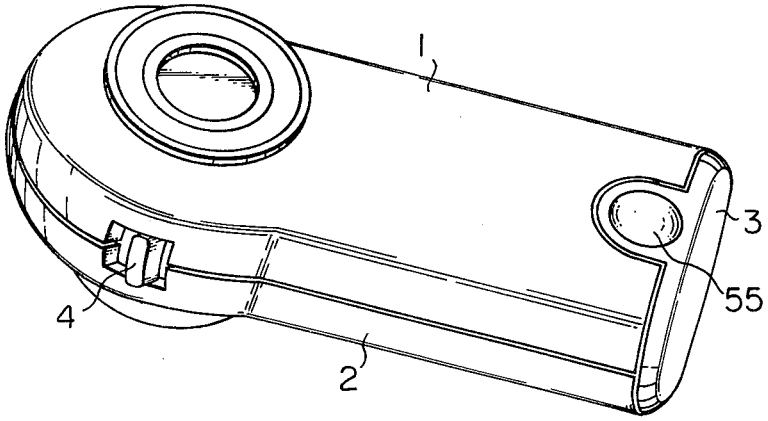
FIG. 1 is a perspective view of the facial treatment device in tthe most preferable embodiment according to the present invention.
Figure 3:
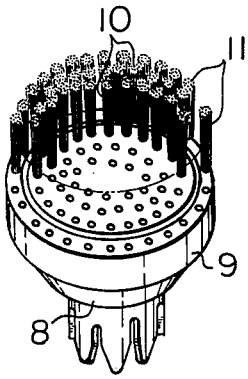
FIG. 3 is a perspective view of a brush type rotary attachment with a part of brushes removed for better illustration of its rotary part and stationary part, which is also used as mounted to the device shown in FIG. 1.
Figure 11A:
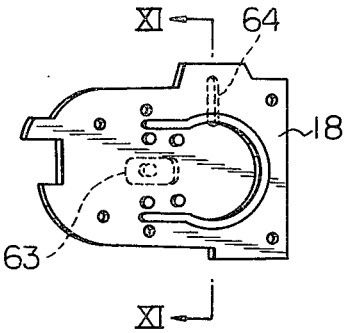
Figure 11B:
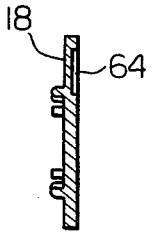
Figure 12A:
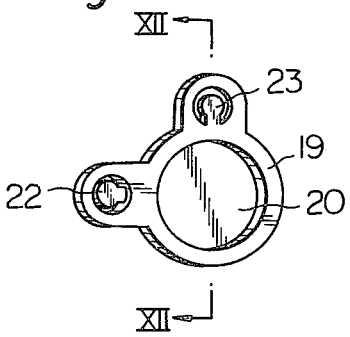
Figure 12B:
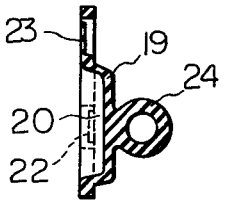
Figure 13:
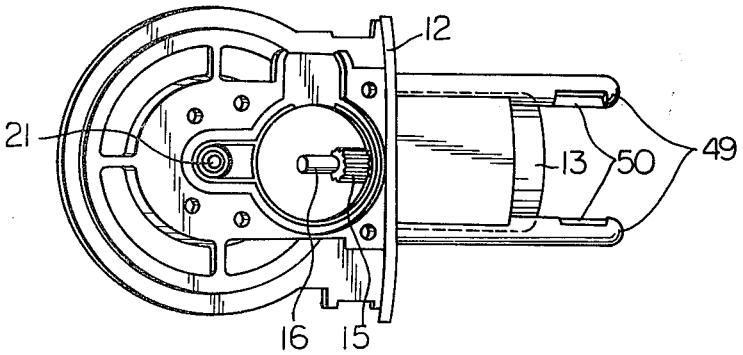
Figure 14:
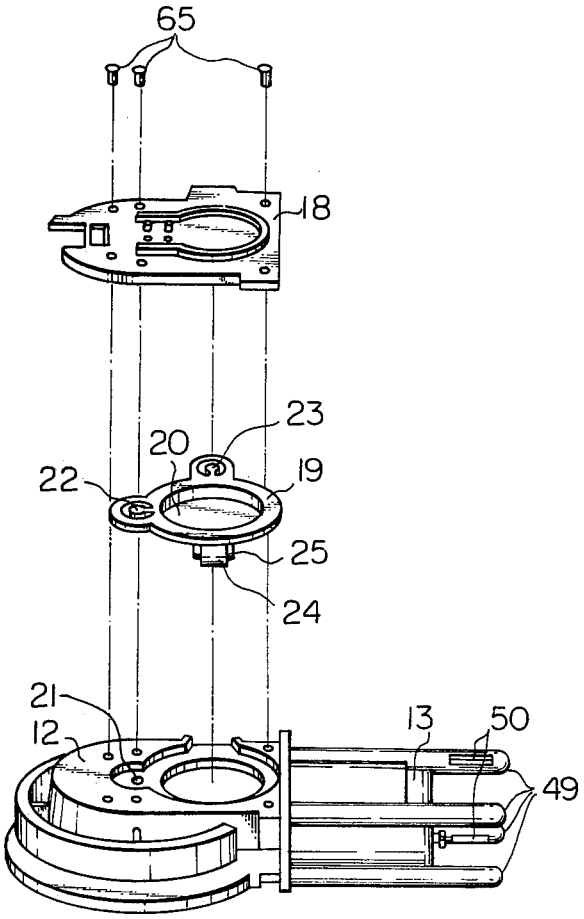

FIGS. 11A and 11B through 13 show an air pumping means and rotary power source block as disassembled of the device in FIG. 1, wherein FIG. 11A is a perspective view of a base plate of the pumping means, FIG. 11B is a sectioned view along line XI—XI in FIG. 11A of the base plate, FIG. 12A is a perspective view of a diaphragm forming the pumping means in cooperation with the base plate of FIGS. 11A and 11B, FIG. 12B is a sectioned view along line XII—XII in FIG. 12A of the diaphragm and FIG. 13 is a perspective view of the rotary power source block to which the diaphragm and base plate are to be mounted;

FIG. 14 is a perspective view for explaining the mounting of the pumping means to the rotary power source block;

FIG. 15 is a fragmentary sectioned view as magnified for showing coupling state of the pumping means to the rotary power source block;

FIG. 16 is a perspective view of a bushing employed in the device of FIG. 1 for securing the sucking attachment to a stationary shaft of the device; and FIG. 17 is an elevation of the rotary part of the brush type rotary attachment shown in FIG. 3 with a part shown in section.

Figure 2:
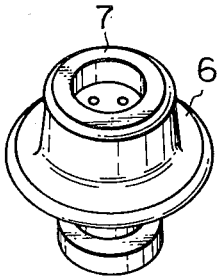
FIG. 2 is a perspective view of a cup-shaped sucking attachment used as mounted to the device shown in FIG. 1.

Referring first to FIGS. 1 to 3, the facial treatment device of an embodiment according to the present invention generally comprises an upper body cover 1, a lower body cover 2 and an end cover 3, which are forming a housing of the device in which a rotary power source and respective rotary and sucking function mechanisms are housed as will be described later, and an electric switch 4 is exposed to the exterior as held between the upper and lower body covers 1 and 2 for actuating the mechanisms in association with a sucking attachment such as a cup-shaped attachment 6 having an elastic skin-engaging cover 7 as shown in FIG. 2 or a rotary attachment such as a brush attachment which comprises a rotary brush 8 and a stationary brush 9 rotatably fitted around the brush 8 and having brush bristles 10 and 11 respectively planted to a circular surface of the brush 8 and a ring-shaped surface of the brush 9, respectively, as shown in FIG. 3 and, while not shown, a massaging attachment, any one of which attachments is selectively mounted to a stationary shaft of the sucking mechanism or a rotary member of the rotary mechanism either of which is accessible on the lower side in FIG. 1 of the device.

Figure 4:
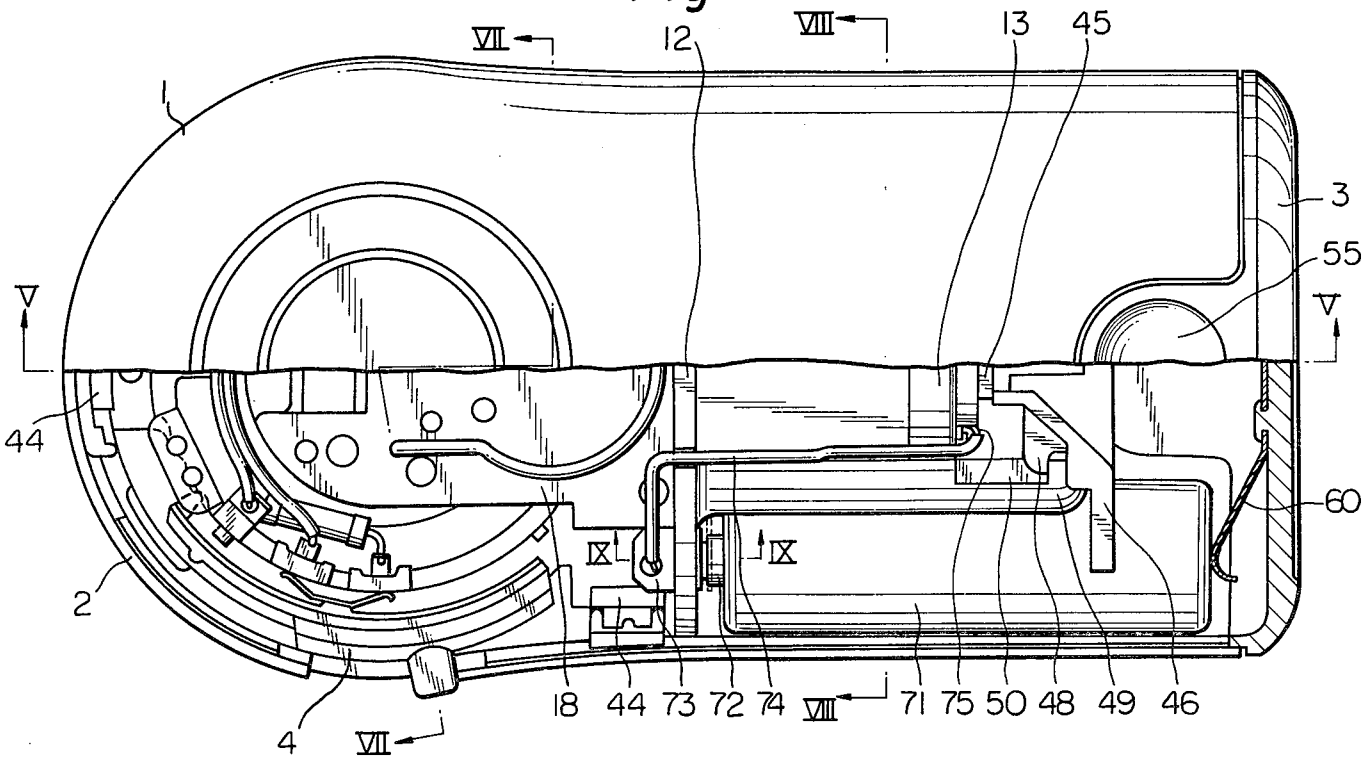
FIG. 4 is a plan view of the device shown in FIG. 1 with a part of the upper body cover removed.
Figure 5:
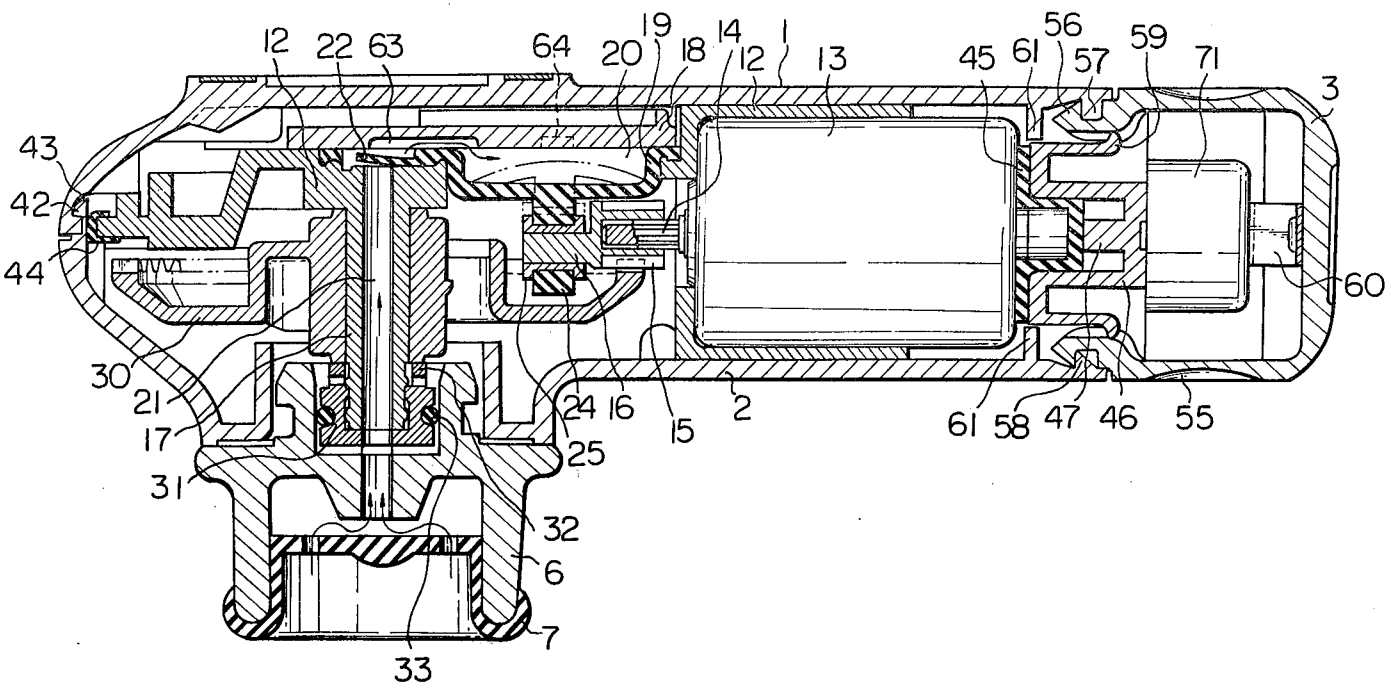
FIG. 5 is a longitudinal section along line V—V in FIG. 4 of the device in a state where the cup-shaped sucking attachment shown in FIG. 2 is mounted to the device.
Figure 6:
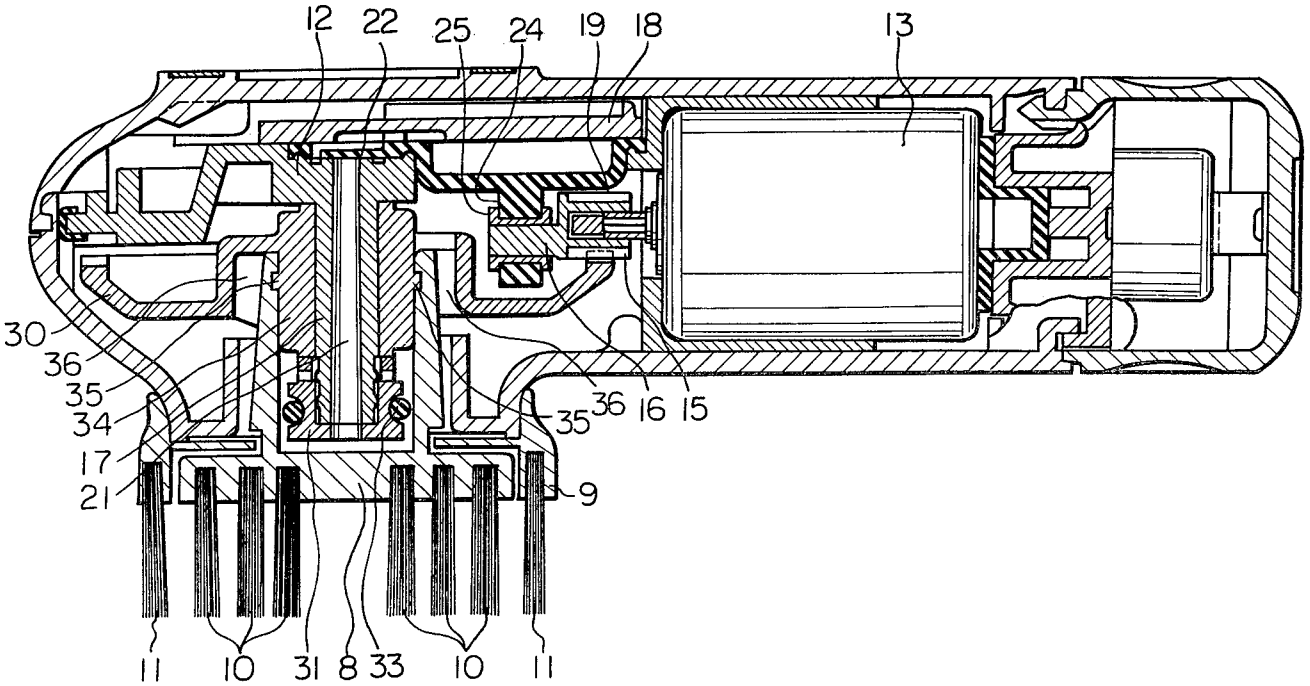
FIG. 6 is also a longitudinal section along the line V—V in FIG. 4 of the device but in a state where the rotary attachment of FIG. 3 is mounted thereto.
Figure 7:
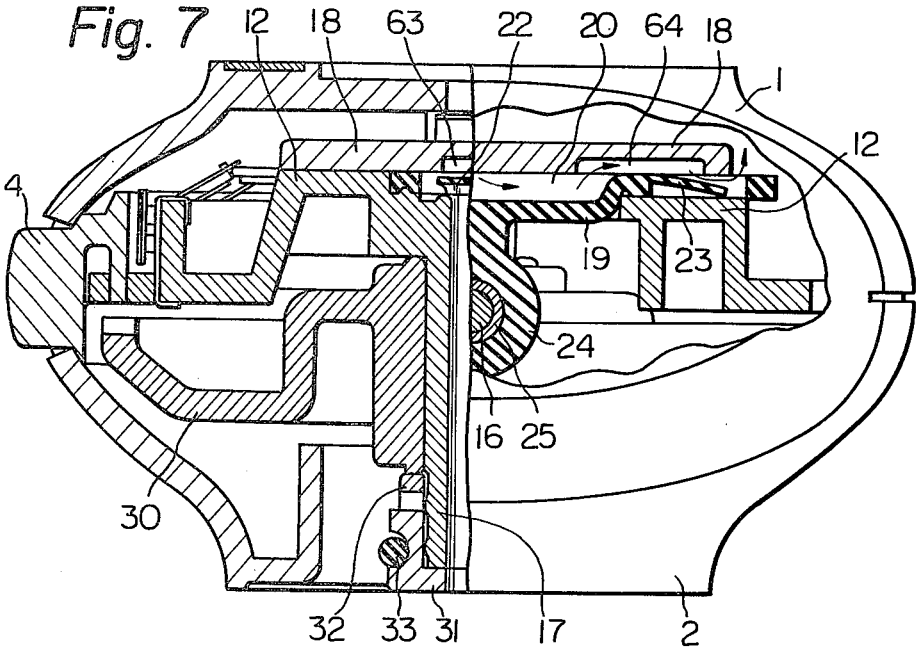
FIG. 7 is a cross section of the device along line VII—VII in FIG. 4.
Figure 8:
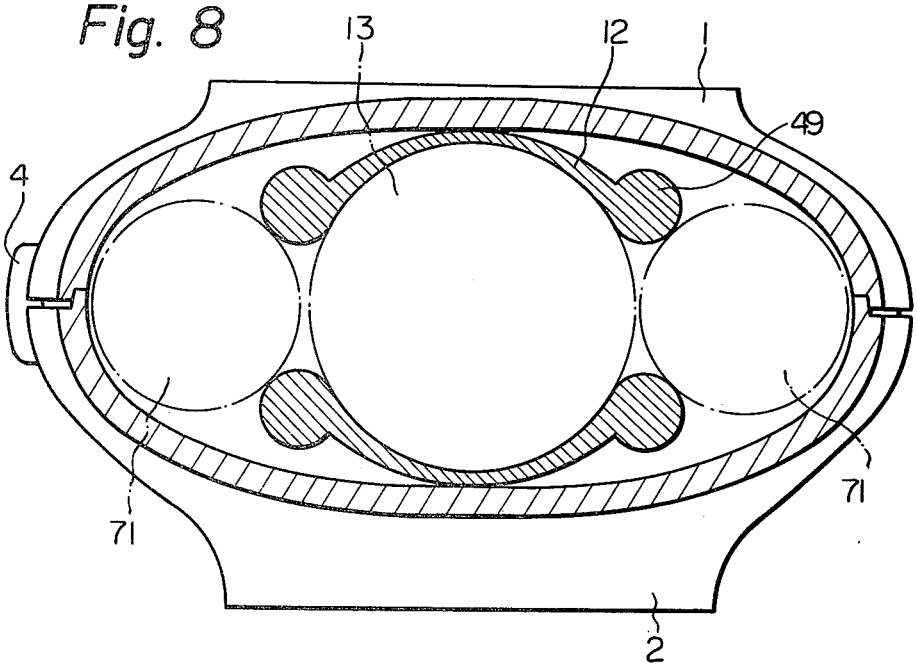
FIG. 8 is a cross section of the device along line VIII-VIII in FIG. 4.

Referring next to the interior structure of the device with reference to FIGS. 4 through 16, a rotary power source block substantially comprises a block base member 12 which is integrally formed of a substantially disk shape body and a plate shape flange extending from a part of peripheral edge of the disk shape body in perpendicular direction so as to be in L-shape in section, an electric motor 13 mounted to the plate shape flange of the base member 12 so as to extend its rotary output shaft 14 through the flange in parallel direction to the disk shape body, and a cylindrical gear wheel 15 having an eccentric shaft 16 extending in longitudinal direction and secured to the output shaft 14 coaxially therewith. As seen in FIGS. 5, 6 or 7, the base member 12 has a tubular stationary shaft 17 formed integrally with the substantially disk shape body substantially at the center thereof so as to extend at right angles with respect to the disk shape body and thus also to the axis of the rotary output shaft 14 of the motor 13. Axial hole 21 of this tubular stationary shaft 17 penetrates through the disk shape body of the member 12.

An air pumping means for achieving a sucking function at an extended open end of the tubular stationary shaft 17 comprises a base plate 18 of a rigid material and a diaphragm 19 of such a resilient material as, for example, rubber as shown best in FIGS. 11 and 12, which will be described more in detail later. Referring briefly to them here, a circular concave part of the diaphragm 19 is disposed in a circular aperture made in the disk shape body of the base member 12 of the power source block as seen in FIG. 13, and the base plate 18 is secured to the disk shape body over the diaphragm 19 to hold it between the member 12 and the base plate 18 so that a pump chamber 20 will be defined in the concave part of the diaphragm 19, which chamber 20 is communicated with the other open end of the axial hole 21 of the tubular stationary shaft 17 through an intake valve 22 formed in the diaphragm 19 as radially extended from the concave part. The diaphragm 19 is further provided with outlet valve 23 also radially exteded from the concave part and a vertically extended arm 24 on the outer side of the pump chamber 20. This arm 24 is formed intergrally with the diaphragm 19 and is provided with a through hole lying in parallel direction to the rotary output shaft 14 of the motor 13, in which hole the eccentric shaft 16 of the gear wheel 15 is inserted through a bearing member 25 flanged at both ends so that the diaphragm 19 will be coupled to the rotary output shaft 14 of the motor through the eccentric shaft 16.

A rotary member in the form of a crown gear 30 for achieving the rotary function is pivoted about the tubular stationary shaft 17 coaxially therewith. Thus, the substantially disk-shaped body of the crown gear 30 extends radially from the stationary shaft 17 and is parallel to the axis of the rotary shaft 14 of the motor 13. Peripheral gear teeth of the crown gear 30 extend vertically with respect to the disk-shaped body thereof and brought into mesh with the gear 15 on the shaft 14, providing thus a space for accommodating the diaphragm arm 24 above the body of the gear 30.

In order to support the crown gear 30 in the pivoted position about the stationary shaft 17, in the present embodiment, a substantially cup-shaped bushing 31 as seen best in FIG. 16 and having an axial hole in the bottom is mounted to an end of the stationary shaft 17 extending through pivoting shaft of the crown gear 30 and thereout so as to align the axial hole with the axial hole 21 of the shaft 17. The bushing 31 is provided on a longitudinal end surface facing the shaft of the crown gear 30 with at least a pair of resilient arms 32 which support the crown gear 30 resiliently and thus rotatably about the shaft 17. There is also provided in the body periphery of the bushing a ring groove 31', in which a resilient ring-shaped packing 33 is engaged and, when the sucking attachment 6 is mounted to the stationary shaft 17 through the bushing 31, this packing 33 engages with the inner wall of a recess made in the attachment 6 to resiliently hold the same while air-tightly sealing a clearance between the body periphery of the bushing 31 and the inner wall of the attachment so as to achieve the sucking function at an open end of the skin-engaging cover 7 on the attachment 6 through an axial hole in the bottom of the recess of the attachment 6 and small air-inlet holes made in the cover 7.

Referring further to the rotary member comprising the crown gear 30 specifically with reference to FIG. 6, the pivoting shaft of the gear denoted by a reference 34 in the drawing is provided with projections 35 formed on the periphery of the shaft 34 and further with radial rib or arm members 36 in the disk-shaped body as defined by a plurality of concentric circular apertures or slits made around the shaft 34. In the illustrated embodiment, the members 36 are formed in the ribs extending in the longitudinal direction of the shaft 34 and outer edges of these ribs 36 upstanding above the dis-shaped body are joined by a cylindrical wall integrally formed on the disk-shaped body so as to maintain mechanical strength of the gear 30. These projections 35 and ribs 36 of the gear 30 are for the purpose of stably holding the rotary attachment during its rotation and use in such manner that, when resilient extensions 37 provided on an axial edge of the rotary brush 8 are fitted over the shaft 34, respective recesses 38 made in the inner surface of these extensions 37 and longitudinal slits 39 between the respective extensions 37 as seen best in FIG. 17 will engage over the projections 35 and the ribs 36, respectively. In this case, the stationary brush 9 fitted around the rotary brush 8 is resiliently mounted to a shallow cylindrical opening of the lower body cover 2 made around the bushing 31 on the extended end of the stationary shaft 17.

Figure 10A:
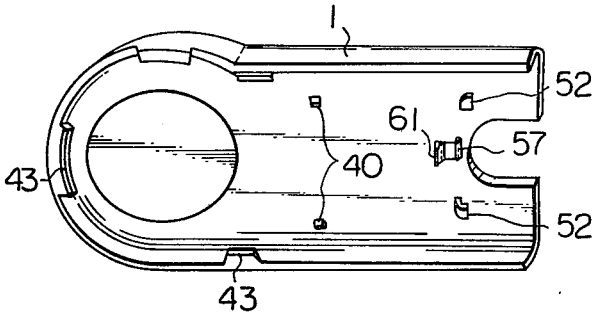
FIGS. 10A through 10D are perspective views showing respective main components as disassembled of the device of FIG. 1.
Figure 10B:
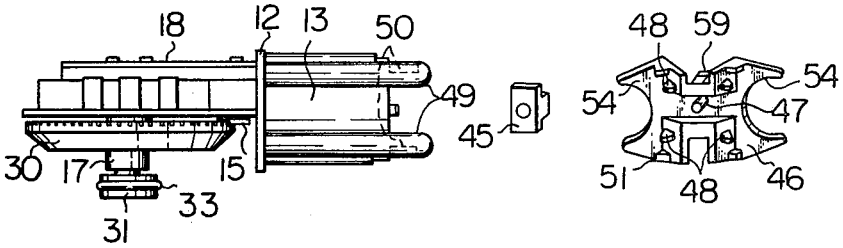
Figure 10C:
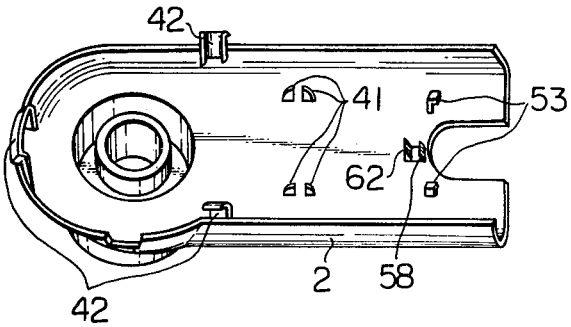
Figure 10D:
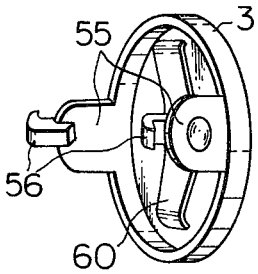

Referring next to assembly works of the device with reference mostly to FIGS. 10A to 10D, the motor 13, gear 15, base plate 18 and diaphragm 19 of the pumping means, crown gear 30, bushing 31 and so on are mounted to the block base member 12 or to the stationary shaft 17 thereof as described in the foregoings to form a mechanical block including the rotary power source block as shown on the left-hand side of FIG. 10B, and this mechanical block is held by the upper and lower body covers 1 and 2 respectively shown in FIGS. 10A and 10B. In this case, the mechanical block is positioned in the body covers by means of projections 40 and 41 provided inside the upper and lower body covers 1 and 2, respectively, for engaging opposing parts of the block base member 12, while the covers 1 and 2 are coupled together by means of engaging projections 42 made in the lower cover 2 and engaged in receiving recess 43 of the upper cover 1. A resilient member 44 is preferably fitted in a clearance between the body covers and the base member 12 as shown in FIGS. 4 to 6 in order to prevent any vibratory motions of the mechanical block. A coupling member 46 is then mounted inside the body covers 1 and 2 on the side of the motor 13 for further coupling the covers 1 and 2, so as to abut the bottom of the motor 13 through a resilient member 45 for cushioning any vibratory motions of the motor. In this case of mounting the member 46 from an open end of the body covers to which the motor bottom is exposed, a central projection of the member 46 urges the cushion member 45 to be depressed against the motor bottom and four projections 48 also of the member 46 engage in respective recesses 50 made in four legs 49 of the block base member 12 for holding the motor 13 so that the coupling member 46 will be secured to the base member 12, whereas peripheral projections 51 of the member 46 are engaged in hooks 52 and 53 respectively made inside the upper and lower covers 1 and 2 so as to couple the both covers together. As seen in FIGS. 4 and 10B, further, the coupling member 46 has arms 54 defining arcuate recesses on both lateral sides for holding therein batteries 71 which are inserted, in the present embodiment, in respective spaces on both longitudinal sides of the motor 13 and between each pair of the motor holding legs 49 as will be seen best in FIGS. 4 and 8. The end cover 3 is finally fitted in the open end of the thus coupled upper and lower body covers 1 and 2, in such manner that an opposing pair of resilient extensions 55 respectively having an engaging hook 56 are manually depressed inward and inserted into the open end of the body covers, whereby the hooks 56 are resiliently engaged to inside projections 57 and 58 of the upper and lower body covers 1 and 2. At this time, resilient projections 59 made on the coupling member 46 engage the respective hooks 56 of the end cover 3 to bias them outward so that the engagement of the hooks 56 to the projections 57 and 58 will be made positive and thereby the cover 3 is stably mounted to the body covers 1 and 2. The end cover 3 has an electrically conductive spring 60 secured to the inner wall of the cover and this spring 60 engages resiliently at both ends with respective end electrodes of the batteries 71 for holding them in position and electrically connecting them with each other. The upper and lower covers 1 and 2 are also provided with inward projections 61 and 62, respectively, for additionally holding the motor 13 at its bottom.

With reference to FIGS. 11 to 15, the structure of the pumping means shall be detailed here. On a surface of the base plate 18 facing the diaphragm 19, there are provided air intake groove 63 and outlet groove 64 at positions opposing the intake valve 22 and outlet valve 23 of the diaphragm 19 when the plate 18 and diaphragm 19 are mounted to the block base member 12 in the manner shown in FIG. 14 and the plate 18 is fixed to the member 12 by means of split pins 65 as shown in FIG. 15. In the mounted state, as shown in FIG. 5, the intake valve 22 and groove 63 are disposed above the axial hole 21 of the stationary shaft 17, while the outlet valve 23 and groove 64 are disposed at another position for communicating the pump chamber 20 with the interior space in the device body as seen in FIG. 7.

Figure 9:
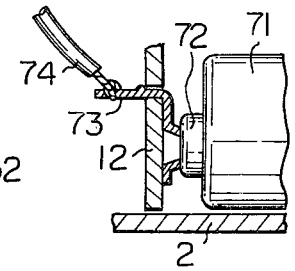
FIG. 9 is a fragmentary sectioned view along line IX—IX in FIG. 4.

Referring to electric connection between the motor 13 and the batteries 71, the respective batteries 71 are inserted into the both side spaces of the motor 13 as disclosed above, in series relation to each other, and one of both-end electrodes of the respective batteries 71 disposed inside is brought into contact with each of a pair of terminals 73 secured to the block base member 12 and connected to a lead wire 74 soldered thereto as shown in FIG. 9 in which the particular electrode is denoted by a reference numeral 72. As seen in FIG. 4, further, one of terminals 73 is directly connected by the wire 74 to one of motor terminals 75, while the other terminal 73 is connected through fixed terminals and sliding contact of the switch 4 to the other motor terminal.

The operation of the device having the foregoing arrangement shall now be explained with reference to FIGS. 1 to 7. In performing the cleaning action as well as massaging action by the rotary function with the use of the brush type attachment including the rotary brush 8 and stationary brush 9, the former of which is mounted to the shaft 34 of the rotary crown gear 30 as shown in FIG. 6, the motor 13 is driven to rotate with the switch 4 in its ON state, and the gear 15 is thereby rotated together with the eccentric shaft 16. The rotation of the gear 15 is transmitted to the crown gear 30 to rotate it about the stationary shaft 17, whereby the rotary brush 8 is rotated together with the shaft 34. At this time, the crown gear 30 rotates smoothly as resiliently supported by the resilient arms 32 of the bushing 31. While performing the skin cleaning by thus rotated brush 8 with a cleansing liquid or the like applied to the skin, the stationary brush 9 secured to the shallow cylindrical opening of the lower body cover 2 encircles the rotating brush 8 so that the cleansing liquid or the like can be prevented from being splashed. During this operation, the diaphragm 19 is also driven with the rotation of the eccentric shaft 16 to reciprocate between its state shown by the solid line and the state shown by the chain line in FIG. 5. However, as the open end side of the axial hole 21 of the stationary shaft 17 is closed by the rotary brush 8 while leaving the least air ventilation around the shaft 34, there is performed no sucking function on the side of the brush bristles of the rotary brush 8.

In performing another type of the cleaning and massaging actions utilizing the sucking function with the use of the cup-shaped sucking attachment 6 mounted to the bushing 31 on the stationary shaft 17 as shown in FIG. 5, the cover 7 of the attachment 6 is butted to the skin and the switch 4 is made ON. Then the diaphragm 19 is driven by the motor 13 through the eccentric shaft 16 to reciprocate as referred to above and an air flow as indicated by arrows through the small holes in the cover 7 and axial hole of the attachment 6, the axial hole of the bushing 31, the axial hole 21 of the stationary shaft 17, the intake valve 22 opened by expansions of the pump chamber 20, the intake groove 63, the chamber 20, the outlet valve 23 opened by compressions of the chamber 20 and the outlet groove 64 is caused to occur. Thus, with the sucking attachment 6 of which opening is closed by the skin abutting the cover 7, the inside space of the cover 7 is made to be of a state of reduced pressure by the pumping action of the diaphragm 19, whereby any dirt or the like on the skin can be sucked and removed by the sucking function due to the reduced pressure inside the attachment 6 and, at the same time, the skin can be subjected also to the massaging action as being sucked. During this operation of the sucking function, the packing 33 air-tightly sealing the clearance between the bushing 31 and the attachment ensures the sucking function to be well achieved in the interior of the attachment 6.

In exchanging the batteries 71 with new ones, the end cover can be easily dismounted from the body covers 1 and 2 by simply depressing the resilient extensions 55 to disengage their hooks 56 from the projections 57 and 58 of the covers 1 and 2, so as to allow the batteries 71 to be pulled out through the thus opened end of the device body.

According to the present invention, as has been described in the foregoings, the rotary member in the form of the crown gear 30 driven by the motor is provided coaxially with the stationary shaft 17 having the axial hole communicating the pump chamber with the exterior, whereby it is enabled to utilize the stationary shaft in common as the sucking tube and the axis of the rotation of the rotary member, and thus the device can be made smaller, due to that the respective components can be arranged compactly.

As the end of the stationary shaft is made to extend out of the rotary member supported rotatably about the shaft, further, the stationary shaft can be utilized commonly as the supporting member of the rotary member, sucking tube and supporting member of the sucking attachment, it is made possible to simplify the structure of the device and, thereby, the device can be made compact, resulting in a lower manufacturing cost.

Yet, the stationary shaft and rotary member are disposed to be accessible on one side of the device, so that either the sucking or rotary attachment can be mounted on the same side of the device and thus the usage of the device can be made easier.

As the stationary shaft and rotary member are coaxially provided to intersect at right angles the axial line of the motor output shaft, the diaphragm and rotary member in the form of the crown gear can be arranged in parallel directions with the axial line so that the diaphragm and rotary member can be disposed in stacking relation to one another so as to reduce the entire thickness of the device. Yet, as the rotary member can be disposed in such parallel direction to the motor's output shaft, the diameter of the crown gear as the rotary member can be made larger enough for achieving desired reduction of rotating rate of the motor output without requiring any special speed reduction mechanism.

As the crown gear is used as the rotary member for transmitting the motor rotation to the rotary attachment in the above referred arrangement, it is enabled to dispose the motor output shaft between the diaphragm and the crown gear, whereby they can be driven by the same rotation transmitting gear mounted to the output shaft, simplifying the driving mechanism, and, yet, an enough space can be provided by the crown gear for disposing the extended arm of the diaphragm connecting the same to the rotation transmitting gear through the eccentric shaft, so that the entire device can be designed to have a reduced thickness in respect of the rotary axis of the rotary member. With this arrangement, further, it is made possible to provide the radial ribs around the rotary shaft of the crown gear utilizing the space still remained adjacent the extended arm of the diaphragm, so that the crown gear as the rotary member can provide the enough mechanical strength for the mounting of the rotary attachment to be driven by the member without increasing or requiring any space therefor.

As the diaphragm is formed to have the extended arm for connecting the diaphragm to the eccentric shaft of the driving gear in integral manner, it is enabled to reduce the number of parts required and yet to achieve a longer life of the diaphragm as compared with conventional pumping means where a separate connecting arm is secured to the diaphragm by means of washer and screw nuts.

Yet further, as the axis of the stationary shaft commonly used as the sucking tube and the supporting shaft of the rotary member is disposed to intersect at right angles the axis of the motor output shaft, the part of the device housing the motor can be utilized as a gripping part of the device while the rotary and sucking functions performing the cleaning and massaging actions with the respective attachment therefor can be achieved in the direction vertical to the axis of the gripping part, whereby the gripping of the device during the use can be made in natural attitude of the user's arm and thus the use of the device is made convenient.

What is claimed is:

1. A facial treatment device in combination with detachable sucking and rotary attachments, said device comprising a housing, a rotary power source housed in said housing and including an output shaft, an air pumping means housed in the housing to be driven by said rotary power source, a stationary shaft disposed at right angles to said output shaft and forming an axial air-flow path communicated at one end with air-intake side of said pumping means and at the other end with the exterior of the housing, and a rotary member including a rotary shaft supported coaxially relative to said stationary shaft to be rotated thereabout by the rotary power source, an end of the stationary shaft on the side of said other end of the air-flow path projecting beyond said rotary shaft, said end of said stationary shaft and said rotary shaft of said rotary member being accessible on a single side of the housing for selectively mounting and detaching the sucking attachment to and from said end of the stationary shaft and the rotary attachment to and from said rotary shaft, said sucking attachment communicating with said air flow path when attached.

2. A facial treatment device according to claim 1, wherein said air pumping means comprises a diaphragm of a resilient material and having an air intake valve abutting said one end of said axial air-flow path of the stationary shaft, said rotary member comprises a crown gear having at the periphery gear teeth errected vertically with respect to the plane of its body, and said diaphragm and crown gear are arranged in parallel to and on respective sides of said axis of the output shaft of the rotary power source.

3. A facial treatment device according to claim 2, wherein said diaphragm is provided with a connecting extension formed integrally therewith for connecting the diaphragm to the output shaft of the rotary power source, and said extension is disposed in a space defined by the diaphragm and the errected gear teeth and body of said crown gear.

4. A facial treatment device according to claim 2, wherein said rotary power source comprises a motor having a drive gear secured to said output shaft, said drive gear having an eccentric shaft, said crown gear is provided adjacent said rotary shaft with radial ribs defining an inner space along the rotary shaft and an outer space along the errected gear teeth, said inner space allowing said rotary attachment to be mounted on the rotary shaft, and said outer space allowing a connecting extension integrally formed with said diaphragm to be accommodated therein as connected to said eccentric shaft.

5. A facial treatment device in combination with detachable sucking and rotary attachments, said device comprising a housing, a rotary power source housed in said housing, an air pumping means housing in the housing to be driven by said rotary power source, a stationary shaft forming an axial air-flow path communicated at one end with air-intake side of said pumping means and at the other end with the exterior of the housing, and a rotary member including a rotary shaft supported coaxially relative to said stationary shaft to be rotated thereabout by the rotary power source, an end of the stationary shaft on the side of said other end of the air-flow path projecting beyond said rotary shaft, said end of said stationary shaft and said rotary shaft of said rotary member being accessible on a single side of the housing for selectively mounting and detaching the sucking attachment to and from said end of the stationary shaft and the rotary attachment to and from said rotary shaft, said stationary shaft and rotary member disposed along an axial line which intersects at right angles the axis of an output shaft of said rotary power source, said air pumping means comprising a diaphragm of a resilient material and having an air intake valve abutting said one end of said axial air-flow path of the stationary shaft, said rotary member comprising a crown gear having its periphery gear teeth extending perpendicularly with respect to the plane of its body, and said diaphragm and crown gear arranged in parallel to and on respective sides of said axis of the output shaft of the rotary power source.

6. A facial treatment device according to claim 5, wherein said stationary shaft extend out of said rotary member at said end for mounting thereto said sucking attachment.

7. A facial treatment device according to claim 6, wherein a bushing having at an axial end a resilient member is secured to said extended end of the stationary shaft, whereby said rotary member is supported on the shaft rotatably by said resilient member and the sucking attachment is mounted to the shaft through said bushing.

8. A facial treatment device according to claim 7, wherein said bushing is provided around the periphery with a resilient packing so that the sucking attachment when mounted is resiliently held by said packing and any clearance between the bushing and the attachment is air-tightly sealed by the packing to achieve at an open end of the attachment an air sucking function.

9. A facial treatment device according to claim 1, wherein said sucking attachment is of a substantially cup shape having an axial hole and mounted to said stationary shaft in an air-tight manner about the shaft except said axial hole of the attachment for allowing an air flow to pass therethrough to said air-flow path of the shaft.

10. A facial treatment device according to claim 1, wherein said rotary attachment is a brush member having brush bristles and resilient extensions axially extending and mounted to said rotary member at said extensions to be thereby rotated.

11. A facial treatment device according to claim 10, wherein said brush member includes a stationary brush fitted to the housing and having brush bristles encircling said brush bristles of said brush member.

12. Apparatus according to claim 1 wherein said housing includes top and bottom surfaces disposed substantially perpendicular to said rotary and stationary shafts, said top and bottom surfaces being generally flat.

* * * * *